US007385188B2

(12) United States Patent
Funsten et al.

(10) Patent No.: US 7,385,188 B2
(45) Date of Patent: Jun. 10, 2008

(54) LINEAR ELECTRIC FIELD TIME-OF-FLIGHT ION MASS SPECTROMETER

(75) Inventors: Herbert O. Funsten, Los Alamos, NM (US); William C. Feldman, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 11/354,353

(22) Filed: Feb. 14, 2006

(65) Prior Publication Data

US 2007/0187584 A1 Aug. 16, 2007

(51) Int. Cl.
*H01J 49/40* (2006.01)

(52) U.S. Cl. ..... 250/287; 250/286

(58) Field of Classification Search ..... 250/287, 250/286, 281, 282

See application file for complete search history.

(56) References Cited

U.S. PATENT DOCUMENTS 5,294,794 A * 3/1994 Davies ..... 250/287

6,806,467 B1 * 10/2004 Funsten et al. ..... 250/287

OTHER PUBLICATIONS

Nier, "A Mass Spectrometer for Isotope and Gas Analysis," The Review of Scientific Instruments, vol. 18, No. 6, pp. 389-411, Jun. 1947.

Holmlid, "Mass Dispersion and Mass Resolution in Crossed Homogeneous Electric and Magnetic Fields: The Wien Velocity Filter as a Mass Spectrometer," International Journal of Mass Spectrometry and Ion Physics, vol. 17 (1975) p. 403-421.

Wiley et al., "Time-of-Flight Mass Spectrometer with Improved Resolution," The Review of Scientific Instruments, vol. 26, No. 12, Dec. 1955.

* cited by examiner

*Primary Examiner*—Kiet T. Nguyen
(74) *Attorney, Agent, or Firm*—Milton D. Wyrick; Mark N. Fitzgerald; Juliet A. Jones

(57) ABSTRACT

A linear electric field ion mass spectrometer having an evacuated enclosure with means for generating a linear electric field located in the evacuated enclosure and means for injecting a sample material into the linear electric field. A source of pulsed ionizing radiation injects ionizing radiation into the linear electric field to ionize atoms or molecules of the sample material, and timing means determine the time elapsed between ionization of atoms or molecules and arrival of an ion out of the ionized atoms or molecules at a predetermined position.

12 Claims, 2 Drawing Sheets

LINEAR ELECTRIC FIELD TIME-OF-FLIGHT ION MASS SPECTROMETER

FIELD OF THE INVENTION

The present invention generally relates to mass spectrometers, and, more specifically, relates to a time-of-flight ion mass spectrometer using a linear electric field. This invention was made with Government support under Contract No. W-7405-ENG-36 awarded by the U.S. Department of Energy. The Government has certain rights in the invention.

BACKGROUND OF THE INVENTION

Mass spectrometers are used extensively in the scientific community to measure and analyze the chemical compositions of substances. In general, a mass spectrometer is made up of a source of ions that are used to ionize neutral atoms or molecules from a solid, liquid or gaseous substance, a mass analyzer that separates the ions in space or time according to their mass or their mass-per-charge ratio, and a detector. Several variations of mass spectrometers are available, such as magnetic sector mass spectrometers, quadrupole mass spectrometers, and time-of-flight mass spectrometers.

All citations to publications contained within this application effectively include those publications herein for all purposes.

The magnetic sector mass spectrometer uses a magnetic field or combined magnetic and electrostatic fields to measure the ion mass-per-charge ratio. In one type of magnetic sector geometry, {see A. O. Nier, *A Mass Spectrometer for Isotope and Gas Analysis, Review of Scientific Instruments*, Vol. 18, No. 6, June 1947, p. 398; L. Holmlid, *Mass Dispersion and Mass Resolution in Crossed Homogeneous Electric and Magnetic Fields: The Wien Velocity Filter as a Mass Spectrometer, International Journal of Mass Spectrometry and Ion Physics*, Vol. 17 (1975) p. 403} only one mass-per-charge species is detected at any one time, so the magnetic field strength and, if present, the electric field strength must be varied in order to obtain a mass spectrum comprising multiple mass-per-charge species. Major limitations on this type of mass spectrometer are the high mass of the magnet and the time that is required to scan the entire mass range one mass at a time.

Another type of magnetic sector mass spectrometer creates a monoenergetic beam of ions, which are spatially dispersed according to mass-per-charge ratio, and which are focused onto an imaging plate. While this type of spectrometer can detect multiple mass-per-charge species can be detected simultaneously, the poor spatial resolution it provides limits its use to a narrow mass range.

Quadrupole mass spectrometers utilize a mass filter having dynamic electric fields between four electrodes. These fields are tailored to allow only one mass-per-charge ion to pass through the filter at a time. Major limitations of quadrupole mass spectrometers are the high mass of mass of the required magnet and the time required to scan the entire mass range one mass at a time.

Time-of-flight mass spectrometers (TOFMS) can detect ions over a wide mass range simultaneously {see W. C. Wiley and I. H. McLaren, *Time-of-Flight Mass Spectrometer with Improved Resolution, Rev. Sci. Instrum.*, Vol. 26, No. 12, Dec. 1955, p. 1150. Mass spectra are derived by measuring the times for individual ions to traverse a known distance through an electrostatic field free region. In general, the mass of an ion is derived in TOFMS by measurement or knowledge of the energy, E, of an ion, measurement of the time, $t_1$, that an ion passes a fixed point in space, $P_1$, and measurement of the later time, $t_2$, that the ion passes a second point, $P_2$, in space located a distance, d, from $P_1$. Using a ion beam of known energy-per-charge E/q, the time-of-flight (TOF) of the ion is $t_{TOF}=t_2-t_1$, and by the ion speed is $v=d/t_{TOF}$. Since $E=0.5\ mv^2$, the ion mass-per-charge m/q is represented by the following equation:

$$\frac{m}{q}=\frac{2Et_{TOF}^2}{qd^2}. \tag{10}$$

The mass-per-charge resolution, commonly referred to as the mass resolving power of a mass spectrometer, is defined as:

$$\frac{\Delta m/q}{m/q}=\frac{\Delta E}{E}+2\frac{\Delta t_{TOF}}{t_{TOF}}+2\frac{\Delta d}{d}, \tag{11}$$

where $\Delta E$, $\Delta t_{TOF}$, and $\Delta d$ are the uncertainties in the knowledge or measurement of the ion's energy, E, time-of-flight, $t_{TOF}$, and distance of travel, d, respectively, in conventional time-of-flight spectrometers.

In a gated TOFMS in which a narrow bunch of ions is periodically injected into the drift region, uncertainty in $t_{TOF}$ may result, for example, from ambiguity in the exact time that an ion entered the drift region due to the finite time, $\Delta t_1$, that the gate is "open," i.e. $\Delta t_1 \approx \Delta t_{TOF}$. The ratio of $\Delta t_{TOF}/t_{TOF}$ can be minimized by decreasing $\Delta t_{TOF}$, for example, by decreasing the time the gate is "open." This ratio can also be minimized by increasing $t_{TOF}$, for example, by increasing the distance, d, that an ion travels in the drift region. Often, a reflectron device is used to increase the distance of travel without increasing the physical size of the drift region.

Uncertainty in the distance of travel, d, can arise if the ion beam has a slight angular divergence so that ions travel slightly different paths, and, therefore, slightly different distances to the detector. The ratio of $\Delta d/d$ can be minimized by employing a long drift region, a small detector, and a highly collimated ion beam.

The uncertainty in the ion energy, E, may result from the initial spread of energies $\Delta E$ of ions emitted from the ion source. Therefore, ions are typically accelerated to an energy E that is much greater than $\Delta E$.

A further limitation of conventional mass spectrometry lies in the fact that the source of ions is a separate component from the time-of-flight section of a spectrometer, and it requires significant resources. First, most ion sources are inherently inefficient, so that few atoms or molecules of a gaseous sample are ionized, thereby requiring a large volume of sample and, in order to maintain a proper vacuum, a large vacuum pumping capacity. Second, the ion source typically generates a continuous ion beam that is gated periodically, creating an inefficient condition in which sample material and electrical energy are wasted during the time the gate is "closed." Third, ions have to be transported from the ion source to the time-of-flight section, requiring, among other things, electrostatic acceleration, steering and focusing. Fourth, typical ion sources introduce a significant spread in energy of the ions so that the ions must be substantially accelerated to minimize the effect of this energy spread on the mass resolving power. Finally, having an ion source separate from the drift region creates an apparatus having large mass and volume.

Still another problem with conventional time-of-flight mass spectrometers is that ions must be localized in space at time $t_1$ in order to minimize $\Delta d$ and, therefore, minimize the mass resolving power. Typically, time $t_1$ corresponds to the time that the ion is located at the entrance to the drift region.

In summary, the limitations on conventional TOFMS include a mass resolving power dependent on the energy spread of the ions emitted from the ion source; the uncertainty in the distance of travel of the ion in its flight path; the problems associated with an ion source that is separate from the drift region; and the need to localize ions in space at time $t_1$. The present invention provides an apparatus that overcomes these limitations and provides more accurate data.

SUMMARY OF THE INVENTION

In order to achieve the objects and purposes of the present invention, and in accordance with its objectives, time-of-flight ion mass spectrometer comprises an evacuated enclosure with means for generating a linear electric field located in the evacuated enclosure and means for injecting a sample material into the linear electric field. A source of pulsed ionizing radiation injects ionizing radiation into the linear electric field to ionize atoms or molecules of the sample material; and timing means determine the time elapsed between ionization of the atoms or molecules and arrival of an ion out of the ionized atoms or molecules at a predetermined position.

BRIEF DESCRIPTION OF THE DRAWINGS

The accompanying drawing, which is incorporated in and forms a part of the specification, illustrates an embodiment of the present invention and, together with the description, serves to explain the principles of the invention. In the drawing.

DETAILED DESCRIPTION

Figure 1:
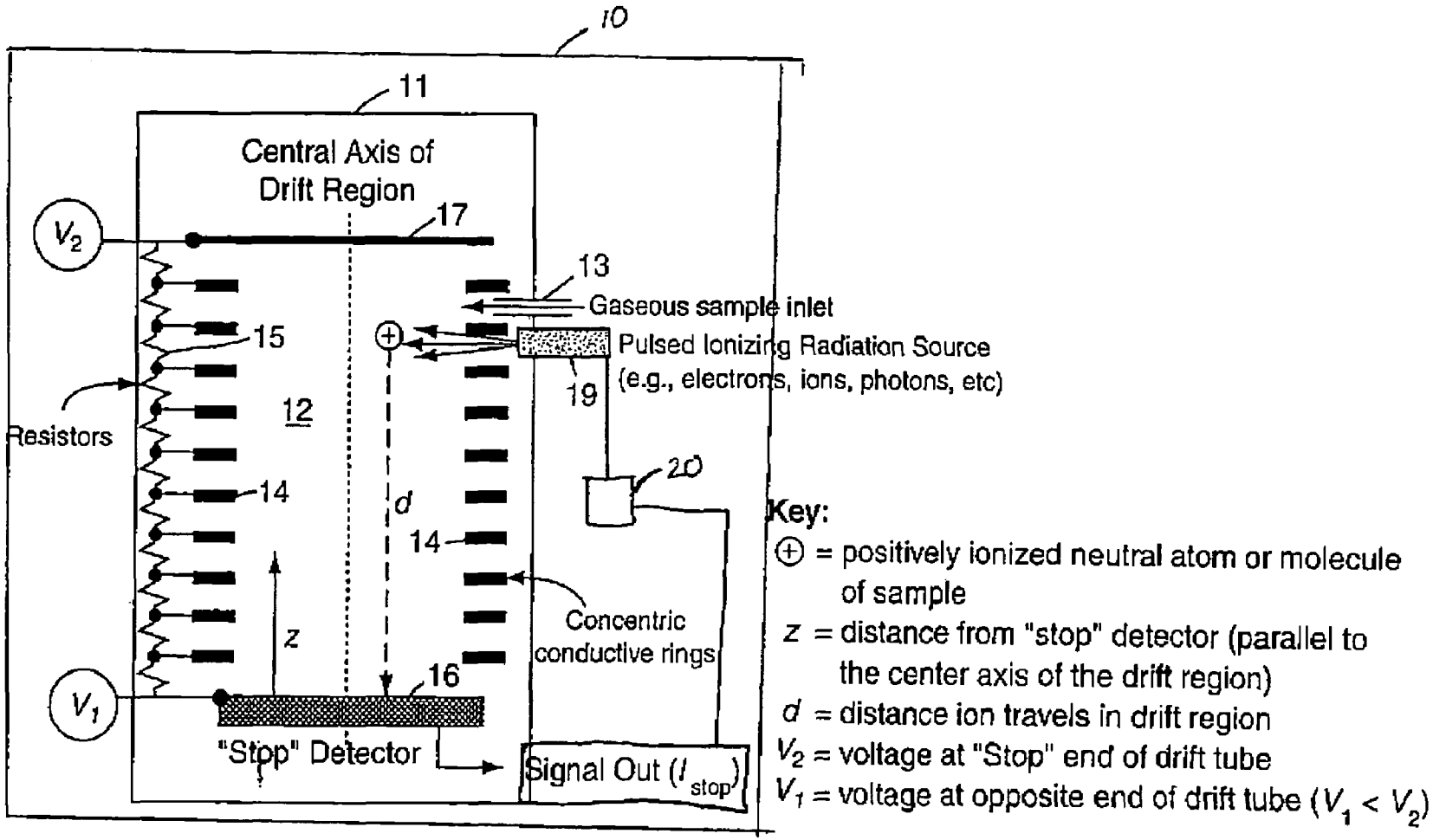
FIG. 1 is a schematic illustration of an embodiment of the present invention showing the elements of the invention and its operation.

The present invention ionizes a sample atom or molecule within a drift region having a linear electric field. The electric field accelerates the ions toward a detector, such that the time-of-flight of an ion, from the time of its ionization to the time of its detection, is independent of the distance the ion travels in the drift region. The invention provides high mass resolving power, smaller resource requirements in such areas as mass, power, volume, and pumping capacity, and elimination of the prior art requirement that the location of an ion at time $t_1$ must be known in order to measure its time-of-flight in the drift region. The invention can be understood more easily through reference to the drawing.

Referring to FIG. 1, there can be seen the time-of-flight mass spectrometer 10 of the present invention resides inside evacuated chamber 11. The gaseous sample to be investigated is introduced into drift region 12 by sample inlet 13, where the sample is a gas . Alternatively, a solid sample could be introduced, for example, at the surface of an electrode near end plate 17. Concentric electrically conductive rings 14 surround drift region 12, and are connected to resistors 15 that are connected between voltage $V_1$ and voltage $V_2$, as shown, with $V_1$ negative with respect to $V_2$. Also as shown, $V_1$ is connected to stop detector 16, and $V_2$ is connected to end plate 17 at the opposite end of drift region 12. This arrangement provides the linear electric field in drift region 12 that is required by the present invention. The resistor values are selected to generate the linear electric field along the central axis of the drift region. Generally, the resistor values increase quadratically from stop detector 16 ($V_1$) to end plate 17 ($V_2$) for a cylindrical drift region 12.

Figure 2:
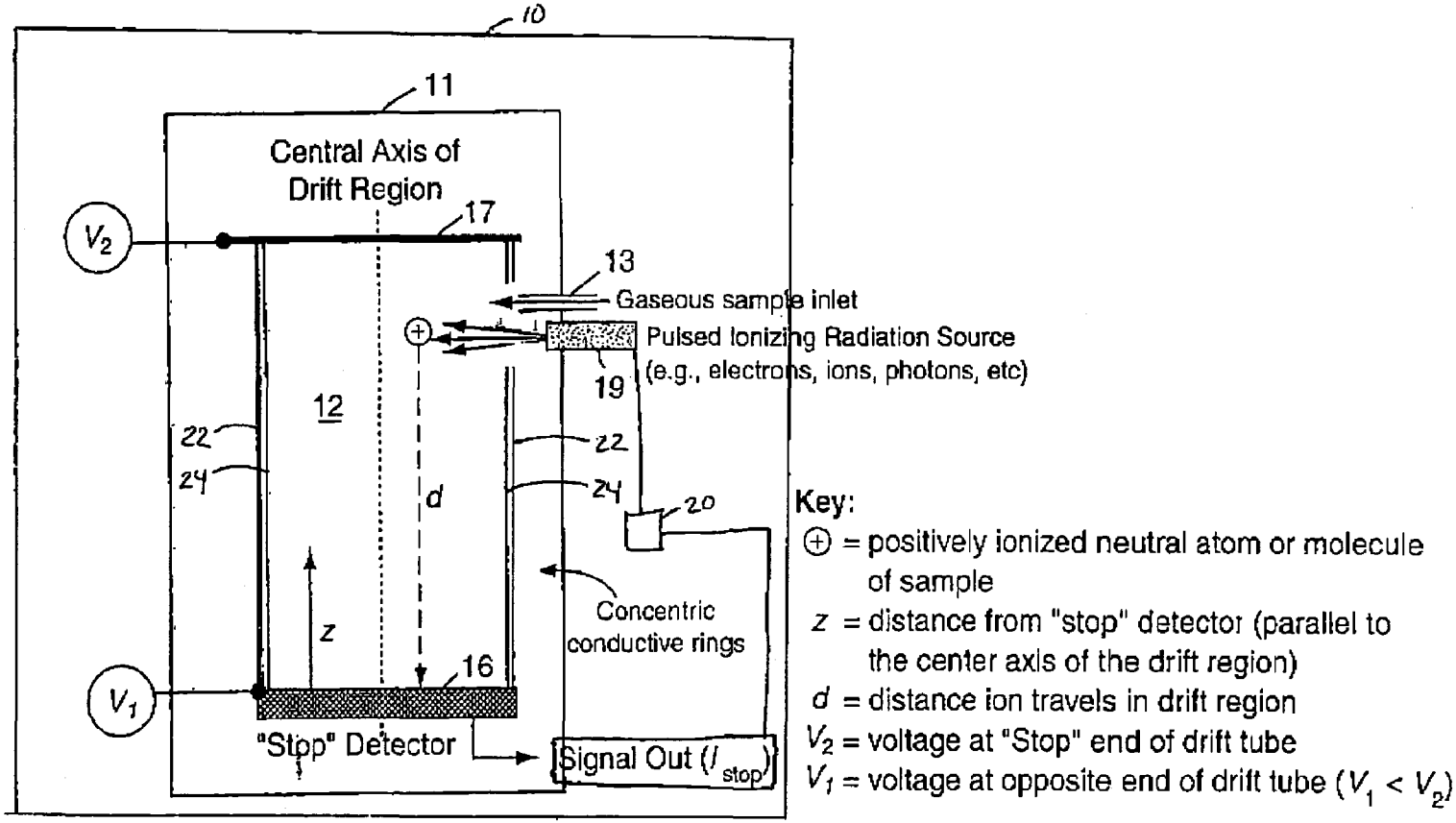
FIG. 2 is a schematic illustration of another embodiment of the present invention showing a cross-sectional view of the mass spectrometer as viewed from the top.

The linear electric field created by $V_1$ and $V_2$ across resistors 15 and concentric rings 14 is coaxial about central axis 18 (the z axis), and has a magnitude, $\epsilon(z)$, that is proportional to the distance, z, normal to stop detector 16, as shown in U.S. Pat. No. 5,168,158, issued December, 1992, to McComas et al. Although concentric ring 14 and resistors 15 effectively provide the linear electric field for the present invention, other methods can be used. For example, referring to FIG. 2, a dielectric cylinder 22 could surround drift region 12, and have a resistive coating 24 applied whose resistance varies with the distance from stop detector 16. Another electric field arrangement could involve a conically shaped grid at stop detector 16 ($V_t$) and a hyperbolic shaped grid located at end plate 17 ($V_2$) as described by D.C. Hamilton et al., in New high resolution electrostatic ion mass analyzer using time-of-flight, Rev. Sci. Instrum. Vol. 61 (1990) 3104-3106. It is also possible That combinations of these methods could be used. Any method of effectively producing a linear electric field within drift region 12 could be used with the present invention.

Stop detector 16 can be any effective single particle detector that can measure the time that an ion strikes the detector with time accuracy much less than the ion's TOF in the drift region. One appropriate stop detector 16 is an electron multiplier detector such as a microchannel plate detector or channel electron multiplier detector that would detect ionized sample atoms or molecules that have been accelerated through drift region 12, and output a signal indicating the detection.

Pulsed ionizing radiation source 19 emits pulses of ionizing radiation through concentric rings 14 and into drift region 12 where it ionizes atoms or molecules of the gas sample of interest. Pulsed ionizing radiation source 19 can emit any effective ionizing radiation, such as photons, electrons, or ions and could be a laser, a source of electrons, or a source of ions.

Pulsed ionizing radiation source 19 ionizes sample atoms or molecules at time, $t_1$, and the ionized atom or molecule is accelerated by the linear electric field toward stop detector 16, where the ionized atom or molecule is detected at time, $t_2$. The difference in times, $t_2-t_1$, corresponds to the time-of-flight of the ionized atom or molecule over the distance that it travels from the time it was ionized to the time it is detected at stop detector 16.

The general equation governing the motion of an ion in a linear electric field is:

$$-qkz = m\frac{d^2z}{dt^2}, \qquad 12$$

where q is the ion charge and k is a constant that depends only upon the electromechanical configuration of the drift region. Equation 12 has the solution of:

$$z = A\sin(\omega t + \phi) \qquad 13$$

where A and $\phi$ are determined by the initial conditions and $\omega^2=kq/m$. A requirement of these relationships is that an ionized sample atom or molecule is initially at rest or partially at rest in the z direction. It is well known to those having skill in this art, that the mean kinetic energy of a gaseous atom or molecule is 1.5 kT, where k is the Boltzman constant, and T is the temperature of the gas. At room temperature (approximately 300 K), the mean energy is approximately 0.04 eV. This initial energy uncertainty $\Delta E$ can influence the mass resolving power according to Equation 11. To minimize $\Delta E/E$ the magnitude of the potentials generating the linear electric field must be sufficiently high to achieve the desired mass resolving power.

Under the initial conditions that stop detector 16 is located at z=0, and that the ion is created at rest at a distance of z=d from stop detector 16, the time-of-flight of the ion according to Equation 13 is:

$$t_{TOF} = \frac{\pi}{2\omega} = \frac{\pi}{2}\left(\frac{m}{qk}\right)^{\frac{1}{2}}. \quad 14$$

In contrast to a conventional linear electric field ion mass spectrometer in which an ion experiences a retarding electric field and follow a half-oscillation path of the harmonic oscillator analog, Equation 14 corresponds to acceleration over a quarter-oscillation path of the harmonic oscillator analog. Rearranging Equation 14 yields:

$$\frac{m}{q} = \frac{4kt_{TOF}^2}{\pi^2}, \quad 15$$

which, as seen, is independent of the distance of travel, d, of the ion in the accelerating linear electric field. Thus, it is clear that the advantage of an acceleration linear electric field, such as is generated in the present invention, in which sample atoms or molecules are ionized while they are considered to be at rest (or nearly so relative to the energy to which they are accelerated by the linear electric field in drift region 12) is that the ions can be created at any location in drift region 12 and they will have a time-of-flight that depends only on the mass-per-charge of the ion and on the electromechanical design of the apparatus. This also allows for a high mass resolving power according to Equation 11, since, for an ideal system, (a) the m/q is independent of the location that the ion is formed in the drift region, so that $\Delta d/d=0$, and (b) the sample atom or molecule is ionized at rest or nearly at rest and is accelerated to a high enough energy so that $\Delta E/E$ is smaller than or comparable to other factors that limit the mass resolving power described in Equation 11. Additionally, this eliminates the requirement of prior art TOFMS, including prior conventional linear electric field devices, that the ionizing radiation particles be localized at a known location at time $t_1$.

It should be noted that the prior art of retarding linear electric field devices teaches TOF mass spectrometry using half-sine-wave ion orbits in which an ion enters a drift region with high energy, but which is slowed down by the electric field so that it reverses direction at the point at which the ion has zero velocity in the z-direction. The ion then returns to and is detected at the same plane from which the ion was originally introduced into the drift region. In the present invention, an ion starts at rest from any position in drift region 12, and is accelerated by the linear electric field in one direction toward stop detector 16. This corresponds to a quarter-sine-wave particle orbit in the solution to the differential equation of motion, Equation 12.

Those with skill in this art recognize that the invention requires a power supply to provide the necessary potential differences required for $V_1$ and $V_2$ and to produce the necessary linear electric field, and for powering pulsed ionizing radiation source 19. Additionally, timing electronic circuits 20 are required to measure the time between generation of the pulse from pulsed ionizing radiation source 19, and the detection of an ion at stop detector 16.

As has been explained, the present invention ionizes the sample atoms or molecules inside drift region 12, not in some external ion source. This allows the invention to be inherently compact, allowing the invention to provide TOFMS apparatus that has a small volume and mass, that requires smaller sample volume, and that requires reduced power resources. The ionization of sample atoms or molecules inside drift region 12 also allows the present invention to accelerate the ions from a condition of near rest independent of the ion's position within drift region 12. This allows use of a spatially broad pulsed ionizing radiation source 19 that is efficient and requires little or no steering, collimation or focusing.

In the present invention, the sample ion is formed when the sample atom or molecule is approximately at rest, and the time-of-flight of the sample ion in drift region 12 is independent of the location at which the sample ion was formed. Therefore, the mass resolving power of the sample ion is likely dependent primarily on the accuracy of the time-of-flight measurement, which includes, for example, the length of time that the ionizing radiation from pulsed ionizing radiation source 19 is admitted into drift region 12, the timing accuracy of the stop detector 16, and the timing accuracy of the time-of-flight measurement electronics.

The present invention requires only a small volume of sample material because the pressure of the sample in the drift region is necessarily low to prevent high voltage arcing within the device and because most ionized sample atoms or molecules are detected. This is in contrast to prior art mass spectrometers, where few ions created in the ion source are injected into the drift region because of the low efficiency of extracting ions from the ion source and because of removal of ions from the ion beam by, among other things, collimating slits, and while the gate is "closed." Additionally, due to the smaller volume of the present invention and the lower required volume of sample, the pumping requirements for evacuation of evacuated chamber 11 is reduced, allowing use of a smaller vacuum pump.

Finally, the present invention requires lower voltage differences across drift region 12. Since a sample atom or molecule is ionized while it is at thermal energies of approximately 0.04 eV at 300 K, the calculated mass-per-charge of the ion is dependent on knowledge accuracy of the ion's energy relative to its accelerated energy as it traverses drift region 12. Because the spread in the initial energies of the sample ions is small, the acceleration voltage ($V_1-V_2$) does not have to be high. To put this into perspective, in some conventional mass spectrometers, ions are extracted from the ion source by electrostatic means, and a potential gradient can exit within the ion source so that ions are created at different potentials that result in an energy spread that can range from about 1 eV to tens of eV, which requires acceleration of the sample ions to a high energy in order to remove the uncertainty of the energies of the sample ions. In one embodiment of the present invention, a single applied voltage (except for the signal electronics) could be applied both as the bias for stop detector 16 and for voltage $V_1$ at stop detector 16. This voltage could be −3 kV at $V_1$, and 0 V at $V_2$.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A time-of-flight ion mass spectrometer comprising:

an evacuated enclosure;

means for generating a linear electric field located in said evacuated enclosure;

means for injecting a sample material into said linear electric field;

a source of pulsed ionizing radiation injecting ionizing radiation into said linear electric field to ionize atoms or molecules of said sample material; and timing means for determining time elapsed between ionization of said atoms or molecules and arrival of an ion out of said ionized atoms or molecules at a predetermined position.

2. The time-of-flight ion mass spectrometer as described in claim 1 wherein said means for generating a linear electric field comprises a plurality of concentric electrically conductive rings including a first electrically conductive ring and a last electrically conductive ring, each adjacent electrically conductive rings being separated by a resistance, with voltage $V_1$ connected through a resistance to said first electrically conductive ring and voltage $V_2$ connected through a resistance to said last electrically conductive ring, where $V_2>V_1$.

3. The time-of-flight ion mass spectrometer as described in claim 1 wherein said means for generating a linear electric field comprises a dielectric cylinder with a resistive film along the interior cylinder surface having a graded resistivity parallel to the central axis of the symmetry with voltage $V_1$, connected to one end of said cylinder and voltage $V_2$ connected to the other end of said cylinder, where $V_{2>V1}$.

4. The time-of-flight ion mass spectrometer as described in claim 1 wherein said source of pulsed ionizing radiation emits electrons.

5. The time-of-flight ion mass spectrometer as described in claim 1 wherein said source of pulsed ionizing radiation emits ions.

6. The time-of-flight ion mass spectrometer as described in claim 1 wherein said source of pulsed ionizing radiation emits photons.

7. The time-of-flight ion mass spectrometer as described in claim 1 wherein said means for injecting a sample injects a gas sample into said linear electric field.

8. The time-of-flight ion mass spectrometer as described in claim 1 wherein said means for injecting a sample injects a solid sample into said linear electric field.

9. The time-of-flight ion mass spectrometer as described in claim 1 wherein said means for determining time elapsed comprises a timing circuit capable of starting timing upon the ionization of sample atoms or molecules in said linear electric field, and stopping timing upon a sample ion arriving at said predetermined position.

10. The time-of-flight ion mass spectrometer as described in claim 9 wherein said means for determining starting timing corresponds to injection of ionizing radiation pulse into a drift region.

11. The time-of-flight ion mass spectrometer as described in claim 9 wherein said timing electronic circuit stops timing upon receipt of's signal from a microchannel plate detector.

12. The time-of-flight ion mass spectrometer as described in claim 9 wherein said timing electronic circuit stops timing upon receipt of a signal from an electron multiplier detector such as a microchannel plate detector or a channel electron multiplier.

* * * * *